United States Patent [19]

Hikichi

[11] Patent Number: 4,689,618

[45] Date of Patent: Aug. 25, 1987

[54] DISPLAY APPARATUS TIME-DIVISION CONTROLLED IN A DYNAMIC DRIVING SYSTEM

[75] Inventor: Hiroshi Hikichi, Tokyo, Japan

[73] Assignee: Nippon Electric Co., Ltd., Tokyo, Japan

[21] Appl. No.: 477,999

[22] Filed: Mar. 23, 1983

[30] Foreign Application Priority Data

Mar. 23, 1982 [JP] Japan ..... 57-45861

[51] Int. Cl.[4] ..... G09G 3/04

[52] U.S. Cl. ..... 340/802; 340/762; 340/813

[58] Field of Search ..... 340/718, 765, 775, 782, 340/784, 789, 790, 799, 800, 753, 754, 793, 814, 805, 802, 813, 766, 767; 350/332

[56] References Cited

U.S. PATENT DOCUMENTS

| | | | |
|---|---|---|---|
| 4,001,699 | 1/1977 | Denny | 340/753 |
| 4,090,189 | 5/1978 | Fisler | 340/813 |
| 4,207,734 | 6/1980 | Moyer | 340/762 |
| 4,242,679 | 12/1980 | Morozumi et al. | 340/813 |
| 4,278,325 | 7/1981 | Kondo | 340/765 |
| 4,340,889 | 7/1982 | Knight et al. | 340/793 |
| 4,462,026 | 7/1984 | Munday | 340/802 |
| 4,542,379 | 9/1985 | Satou | 340/762 |

*Primary Examiner*—Gerald L. Brigance

*Attorney, Agent, or Firm*—Sughrue, Mion, Zinn, Macpeak, and Seas

[57] ABSTRACT

A control circuit for a time division multielement display in which a display information generator provides display information to all elements of the display in common, a digital signal generator enables each of the elements in sequence, an active period control circuit controls the enabling signal of the signal generator, and an active period set circuit sets the length of time the control circuit causes an element to be enabled, whereby erroneous displays due to slow transitions are eliminated by shortening the enabled period.

8 Claims, 10 Drawing Figures

FIG. 1(a)
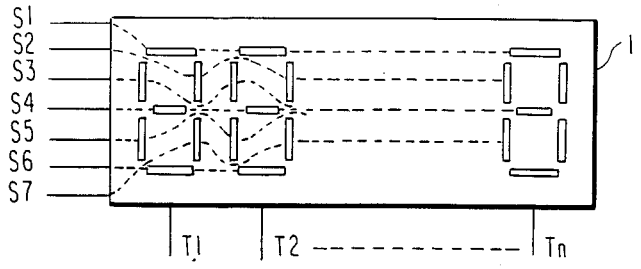
FIG. 1(b)
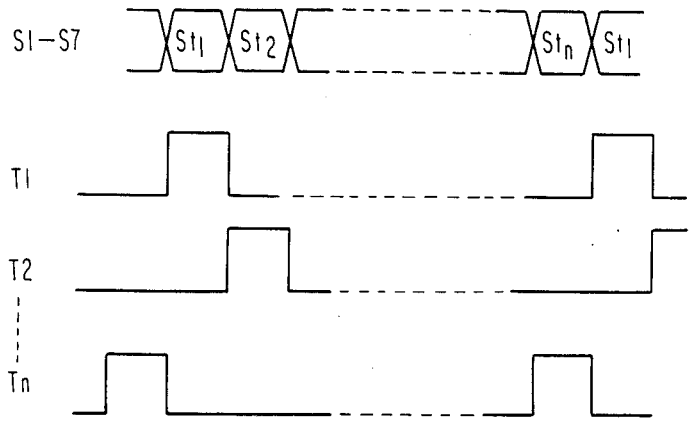
FIG. 2
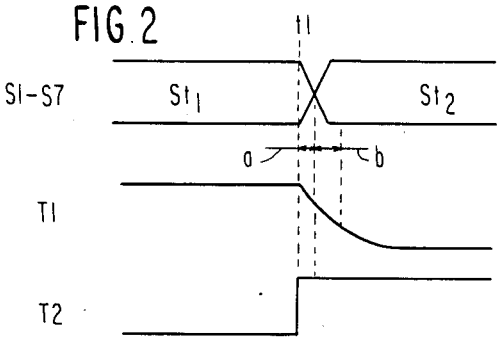
FIG. 3
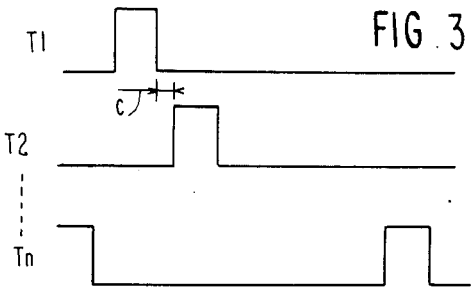
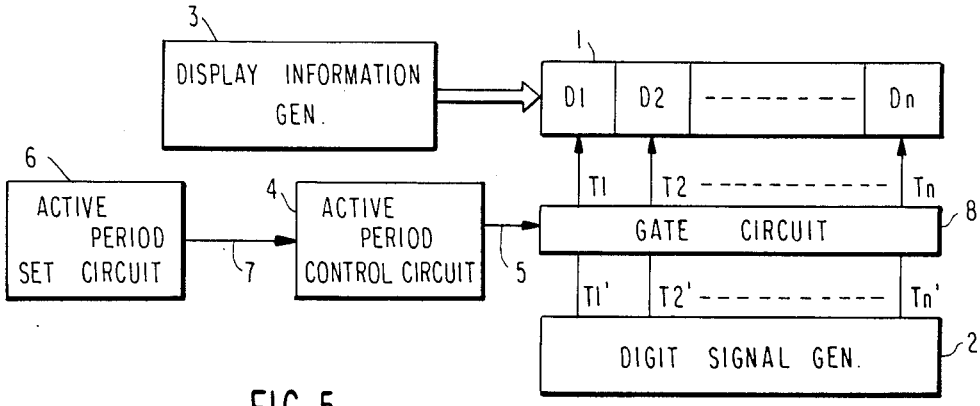
FIG. 5

FIG. 6
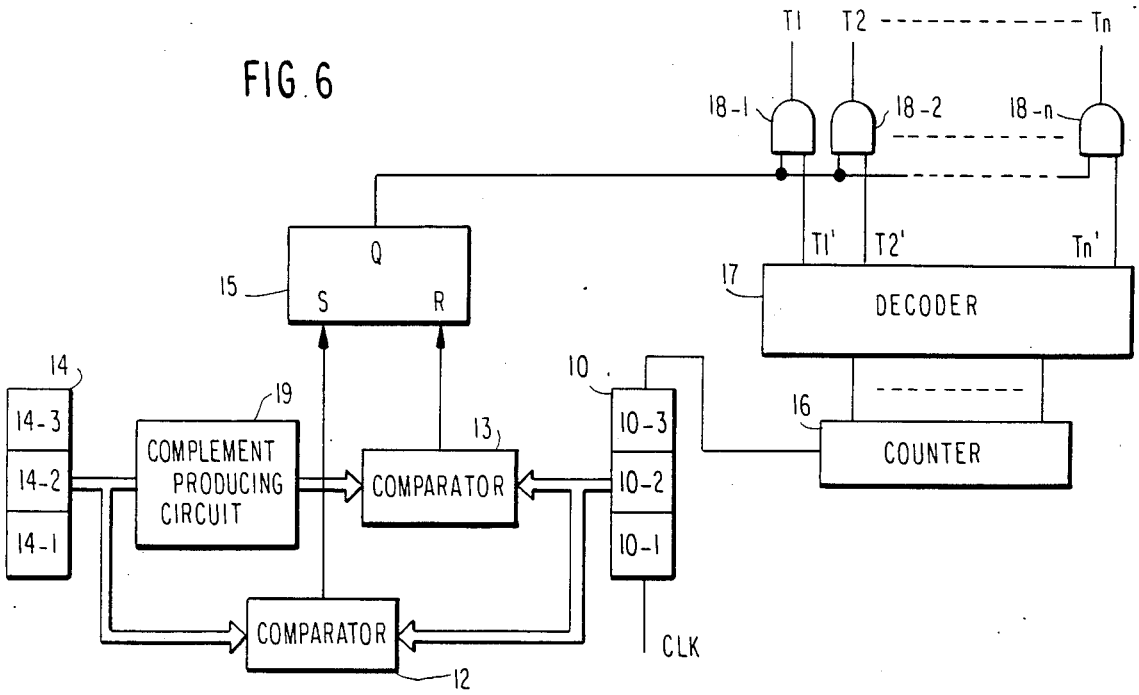
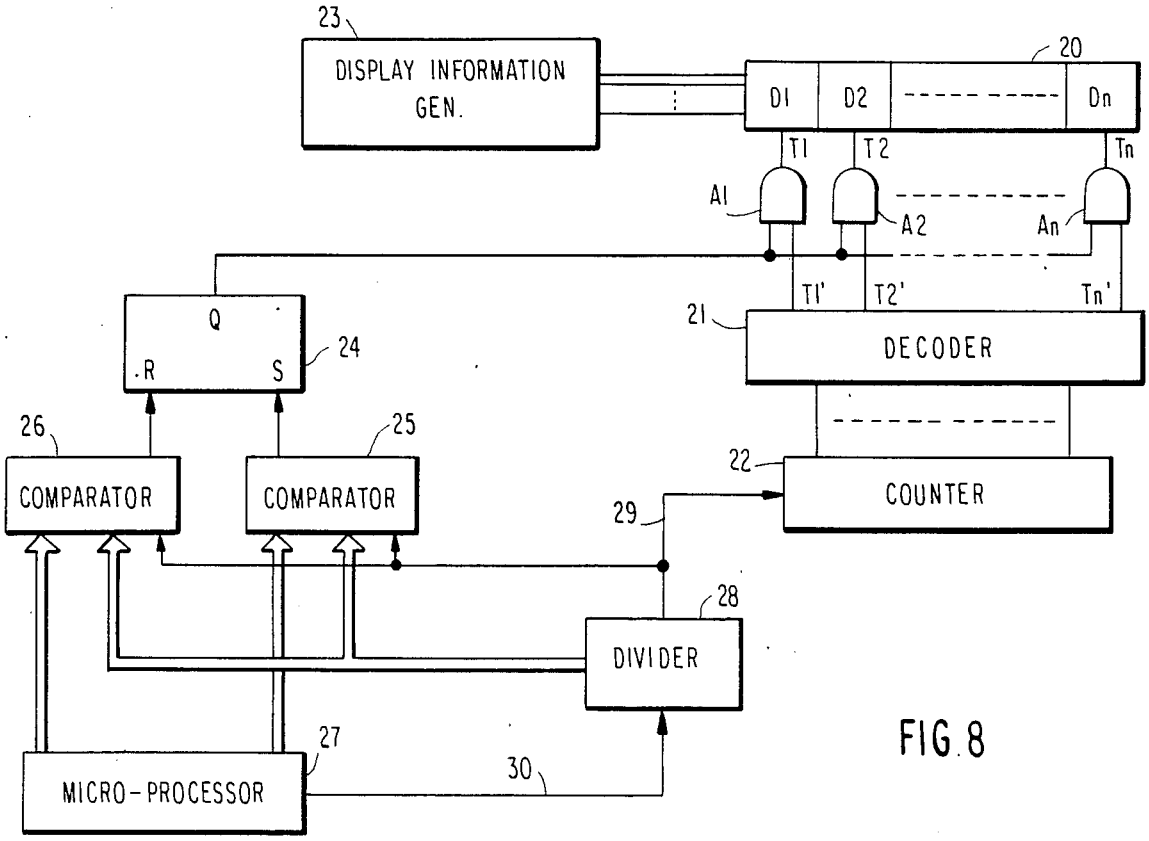
FIG. 8

DISPLAY APPARATUS TIME-DIVISION CONTROLLED IN A DYNAMIC DRIVING SYSTEM

BACKGROUND OF THE INVENTION

The present invention relates to a display apparatus, and more particularly to a display apparatus which is dynamically driven by a time-division system.

The display apparatus of a dynamic driving type employing the time-division system requires digit information for selecting a digit to be displayed and display information to be supplied to the selected digit. Since the digit signals are selectively sent to the display elements at the respective digits, independent signal lines must be separately provided to the respective display elements. On the other hand, the display information signals are transmitted through common signal lines to all the display elements in common. This dynamic driving is effective for a multidigit display apparatus employing, as display elements, fluorescent display panels, plasma display panels, light emitting diodes, or the like. In the multidigit display apparatus of the dynamic-driving type, the digit signal must be applied to the display element at the selected digit only at one instant. If not, erroneous display at the adjacent digits would occur, because the display information signal is applied to the display elements of all the digits in common. Especially, the shapes of the rising edge and the falling edge of the digit information signal pulse should be sharp in order to prevent erroneous display at the adjacent digit. However, the apparatus inevitably has both the stray capacitances of display elements and the wiring capacitances of the signal lines. These capacitances force rise and fall of the digit signal pulse to become slow. Therefore, it is very difficult to prevent overlap of one digit signal pulse with the adjacent digit signal pulses. It has accordingly been common practice to shorten the active period of each digit signal pulse in consideration of the rise time and/or fall time thereof. With the shortened active period, the overlap of the digit signal pulses can be avoided.

However, when the active period is markedly shortened, the display luminance is also markedly lowered to make the recognition of the displayed content difficult. Moreover, the rise time and/or fall time of the digit signal pulses are not always constant, but they depend upon the lengths of the corresponding signal lines and the number of the display elements to be coupled to the signal lines. This brings about the disadvantage that a large number of digit signal control circuits for controlling the active periods conforming with the kind of the display elements and the number of the display elements are needed.

The deterioration in rising and falling characteristics of the signal pulses arises, not only for the digit information signals, but also for display information signals. In case of driving a large-sized display apparatus, these two signals with deteriorated rising and falling characteristics frequently give rise to a flickering of the display, erroneous display, double display, etc.

SUMMARY OF THE INVENTION

An object of the present invention is to provide a display apparatus in which the active periods of display control signals can be easily varied.

Another object of the present invention is to provide a display apparatus in which the active periods of digit signals can be programmably varied.

Still another object of the present invention is to provide a display apparatus in which erroneous display or the flickering of display does not occur.

Yet another object of the present invention is to provide a display apparatus which has a circuitry controling the interdigital separation of display control signals without remarkably lowering the luminance of display.

A further object of the present invention is to provide a display apparatus which can programmably change the luminance of display.

A still further object of the present invention is to provide a display apparatus in which a digit signal and/or a display information signal for a selected display element is prevented from affecting the adjacent elements.

A display apparatus according to the present invention comprises a display device which includes a plurality of display elements, a first circuit which generates at least one digit signal to select one of the display elements in time division, a second circuit which generates at least one display information signal to determine the content of display of the selected display element, a first control circuit for applying the digit signal and the display information signal to the display elements, and a second control circuit for changing an application period of either one or both of the digit signal and the display information signal to be applied to the display elements.

According to the present invention, the application period of the digit signal and/or the display information signal to the display elements can be varied at will by the second control circuit. That is, the active period of either one or both of the digit signal and the display information signal can be programmably varied by controlling its or their application period. For example, the start timing of the application of the signal are controlled, or the end timing thereof are controlled, whereby the desired active period of the signal can be easily obtained. Of course, both the start timing and the end timing may be controlled as well.

Especially, the length of the active period of the display control signals, i.e. the digit signal and/or the display information signal, can be optimized in accordance with the kinds and the size of display elements or the number of display elements, so that the control circuitry of this invention is of general-purpose and, further, realizes good display without incurring a significant lowering of the luminance. Moreover, as regards two adjacent display elements, the end timing of the digit signal and/or the display information signal of the preceding element and/or the start timing of the digit signal and/or the display information signal of the succeeding element can be controlled uniquely or independently of each other, so that the mutual interference of the signals for the respective display elements can be prevented. Accordingly, any of erroneous display, display flickering, double display etc. are also prevented. Further, by controlling the active period in accordance with the brightness in the circumstances in which the display apparatus is placed the optimum luminance of display meeting the circumstances can be established.

BRIEF DESCRIPTION OF THE DRAWINGS

FIG. 1(*a*) is a block diagram of a display section in a known multidigit display apparatus, while FIG. 1(*b*) is a timing chart of display information signals and digit signals which are supplied to the display section;

FIG. 2 is a timing chart of digit signals and display information signals for explaining erroneous display;

FIG. 3 is a timing chart showing digit signals of shortened active periods;

FIG. 5 is a block diagram showing another embodiment of the present invention;

FIG. 6 is a block diagram showing still another embodiment of the present invention;

FIG. 8 is a block diagram showing yet another embodiment of the present invention.

DESCRIPTION OF THE PRIOR ART

Figure 4:
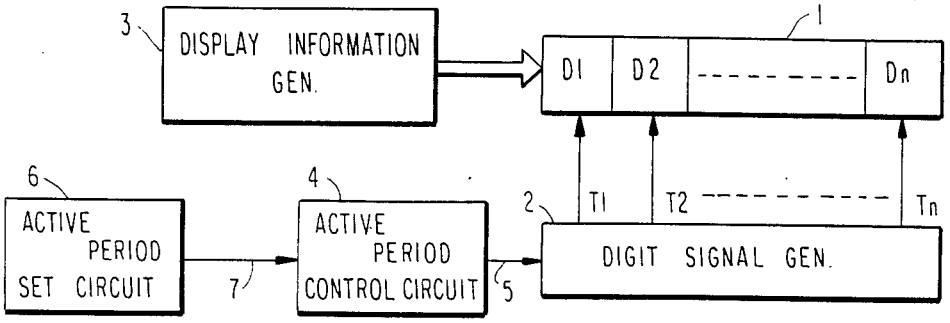
FIG. 4(*a*) is a block diagram showing an embodiment of the present invention, while FIG. 4(*b*) is a timing chart thereof.
Figure 4:
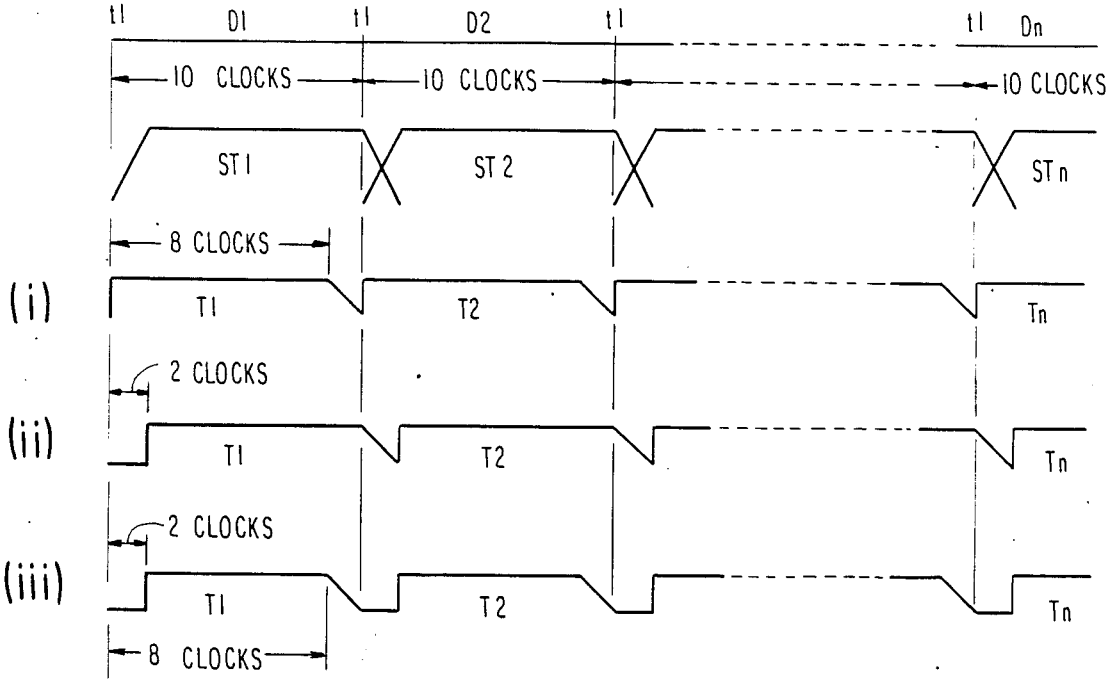

FIG. 1(*a*) is a block diagram of a display section in a prior-art display apparatus. Here, a 7-segment multi-digit display element constructed of light emitting diodes is exemplified as a display device. Display elements in a number of n are arrayed in series, and the respective elements are sequentially selected and activated by digit signals $T_1$–$T_n$ which are generateed by time division. Each of the elements consists of 7 segments, which are respectively supplied with segment signals $S_1$–$S_7$ produced in accordance with display information transferred from, for example, a microprocessor. The segment signals are supplied to all the elements in common. It is the advantage of the dynamic driving by means of the time division system that a large number of display elements can be driven with a small number of terminals, because display information can be applied through only seven terminals to all elements. In the dynamic drive, as illustrated in FIG. 1(*b*), the segment signals $S_1$–$S_7$ are supplied to the display elements in synchronism with the digit signals $T_1$–$T_n$ which are sequentially generated for the respective elements. As a result, display information can be selectively applied to the desired elements. More specifically, when the digit signal $T_1$ is at an active level (for example, high level), the information $St_1$ to be displayed at the leftmost element of the display unit 1, are supplied as segment signals $S_1$–$S_2$, whereby the information $St_1$ is displayed at the leftmost element during the active level of the digit signal $T_1$. Subsequently, the digit signal $T_2$ for selecting the adjacent element assumes the active level and display information $St_2$ is supplied as segment signals $S_1$–$S_7$ in synchronism with the digit signal $T_2$, whereby the next information $St_2$ is displayed at the second digit as reckoned from the leftmost digit. Similar operations are subsequently performed as to the sequentially generated digit signals $T_3$–$T_n$. Since the digit signals $T_1$–$T_n$ and the segment signals $St_1$–$St_n$ are generated sequentially and continuously at a speed of, e.g., about 500 Hz, it seems to the human eyes that the desired information are simultaneously indicated on all the provided display elements.

When the display device is actually controlled by such dynamic driving, the waveforms of the digit signals and the display segment signals lose their sharpness as shown in FIG. 2. In the Figure, $S_1$–$S_7$ represent display information $St_1$ and $St_2$ each consisting of 7 segment signals. $T_1$ and $T_2$ represent digit signals of a first digit and a second digit adjacent to the first digit. The display information is prepared by a display processor such as a microprocessor, and the phenomenon in which the signals of information $ST_1$ and the signals of information $St_2$ overlap arises at the point, at which the two display information signals switch over. On the other hand, the digit signals are produced by decoding outputs from a counter. By way of example, when a P-channel type MOS transistor is used for the output stage of a decoder, the start timing of the digit signal can be controlled with the open drain output of the transistor, and hence, the rising-up thereof can be made comparatively sharp. However, the falling-down of the digit signal is controlled by a pull-down resistor connected to a signal line, and therefore, it becomes a slowly-changing waveform over a long period. In particular, the existence of the capacitance of the display elements (for example, grid capacitance in a fluorescent display panel) and wiring capacitance of the signal line produces a slow transition in the falling waveform as illustrated at $T_1$ in FIG. 2. Such a slow transition develops similarly even when other circuitry is used. Of course, it is possible that the fast transition will become a slow transition in another circuitry. In FIG. 2, the timing point $t_1$ is the theoretical end point of the digit signal $T_1$ and is also the theoretical start point of the digit signal $T_2$. The display information also are switched from $St_1$ over to $St_2$ at this timing point $t_1$.

Accordingly, in a time interval a in which the digit signal $T_2$ for selecting the second element is generated before the information $St_1$ indicated at the leftmost element disappears completely, the information $St_1$ to be indicated at the leftmost element is displayed on the second element for a moment. A further disadvantage is that, in a time interval b in which the display information $St_2$ to be displayed on the second element is supplied before the digit signal $T_1$ for the leftmost element disappears, the information $St_2$ is faintly indicated at the first element as erroneous display. In a case where the respective elements have short display cycles and are driven at high speed, double display is manifested.

One solution that has been considered is to separate a digit signal from adjacent digit signals by inserting a certain fixed interval c as illustrated in FIG. 3. However, insofar as the time c is fixed, the aforementioned disadvantages are still involved in an apparatus having a large number of elements or an apparatus having large-sized display elements. In an apparatus having a small number of display elements or small-sized display elements, there occurs the disadvantage that the active period is too short, so the display has reduced luminance and becomes very difficult to see if the circuitry for producing digit signals with a fixed interval c which is designated for a large-sized display element or a large-number of display elements is used.

In display apparatuses, the control of the display luminance is an important factor, and it is desired that information can be indicated at a luminance conforming to the background lighting. Accordingly, even when the successive digit signals are prevented from overlapping, it is required to set the active period and separate the digit signals in consideration of the luminance in accordance with the surroundings.

DETAILED DESCRIPTION OF THE INVENTION

FIG. 4(*a*) is a block diagram showing an embodiment of the present invention. A display device 1 has display blocks of n elements $D_1$–$D_n$, and it is coupled with a digit signal generator circuit 2 and a display information generator circuit 3. The digit signal generator circuit 2 is coupled with the display device 1 so that n digit signals $T_1$–$T_n$ can be sequentially supplied to the corresponding elements $D_1$–$D_n$ in time division. On the other hand, the display information generator circuit 3 is commonly coupled to all display elements $D_1$–$D_n$ in the display device 1 so that generated segment information S can be transferred to the respective elements of the display device 1 in common. Such arrangement is the same as in the prior-art display apparatus. This embodiment comprises an active period control circuit 4 which is coupled to the digit signal generator circuit 2 and which delivers a control signal 5 for controlling an active period of each digit signals $T_1$–$T_n$. The digit signal generator circuit 2 produces each digit signals $T_1$–$T_n$ only when the control signal 5 is applied to this circuit 2. Further, the embodiment comprises an active period set circuit 6 which is coupled to the active period control circuit 4 and which delivers the signal 7 instructive of the output period of the control signal 5. The control signal 5 is applied to the digit signal generator circuit 2 in response to the signal 7. That is, the digit signals $T_1$–$T_n$ are respectively produced and supplied to the corresponding elements of the display device 1 during the period determined by the control signal 5. The active period set circuit 6 changes the output period of the control signal 5 in accordance with the number of display elements and/or the size of an element to be used and/or circumstances in which the display apparatus is used. The active period control circuit 4 may have the function of delivering the control signal 5 when the signal 7 is at a predetermined voltage level, and stopping the delivery of the control signal 5 when the voltage level of the signal has changed. It can be constructed of, for example, a set-reset flip-flop circuit. The active period set circuit 6 should desirably have the function of programmably controlling a set timing and/or a reset timing of the flip-flop allotted output period of the digit signal. This circuit 6 includes, for example, a first program counter and a second program counter, both of them beginning a count operation in response to a signal which designates the theoretical end point (the timing point $t_1$ as shown in FIG. 2) or a theoretical start point equal to the timing point $t_1$ determined by the apparatus having a large number of display elements or/and a large size of display elements. The first program counter outputs the reset signal at the time when the count operation for the preset data thereof has been finished. The second program counter outputs the set signal at the time when the count operation for the preset data thereof has been finished. As the result, the following three types of controls can be executed. In this case, it is assumed that the first program counter and the second program counter can count a maximum of 10 clock periods in response to the timing signal $t_1$ and output the reset signal and the set signal, respectively, when the count operation of preset value have been finished.

(i) When the 8 value is preset in the first program counter and 0 value is preset in the second program counter, the set signal is outputted at the time $t_1$, while the reset signal is outputted after 8 clocks are counted. Therefore, the control signal 5 in FIG. 4(*a*) can be stopped earlier than a fixed period of 10 clock periods. As a result, the end timing of the digit signal is advanced. Therefore, even when the fall characteristic of the digit signal is gentle, the erroneous display which arises in the period b in FIG. 2 is avoided (FIG. 4(*b*)-(i)).

(ii) When the 10 value is preset in the first program counter and 2 value is preset in the second program counter, the set signal is outputted after 2 clocks from the timing point $t_1$, while the reset signal is outputted after 10 clocks. Therefore, the output timing of each digit signals can be retarded. It is accordingly possible to prevent the erroneous display arising in the period a in FIG. 2 (FIG. 4(*b*)-(ii)).

(iii) When the 8 value is preset in the first program counter and 2 value is preset in the second program counter, both the erroneous displays which arise in the periods a and b in FIG. 2 can be prevented. Moreover, since the preset value can be decided at will, the optimum digit signals can be prepared in accordance with the number of display elements or the size of display elements.

While FIGS. 4(*a*) and 4(*b*) have illustrated the example in which the operation of the digit signal generator circuit 2, in other words, the production of the digit signal, is controlled by the control signal 5. However, a gate circuit 8 may well be interposed between the digit signal generator circuit 2 and the display device 1 as shown in FIG. 5. In this case, the control signal 5 is supplied to the gate circuit 8, whereby the application period of the digit signal to be applied to the display device 1 is controlled.

Another embodiment of the present invention is shown in FIG. 6. Here, the digit signal generator circuit and the control portions therefor will be described in detail and the display information generator circuit is omitted.

Referring to FIG. 6, a binary counter 10 executes a counting operation is synchronism with a clock signal CLK. The count value of the binary counter 10 is applied to a comparator 12 and another comparator 13 in common. The comparator 12 compares the count value of the binary counter 10 with the content of a register 14, and sets a flip-flop 15 when both the values have coincided. The comparator 13 compares the count value of the binary counter 10 with the two's complement value of the content of the register 14, and resets the flip-flop 15 when both the values have coincided. A complement producing circuit 19 converts the content of the register 14 into the two's complement values, which is applied to the comparator 13. The flip-flop 15 provides a high level signal in response to the set signal, and a low level signal in response to the reset signal. Meanwhile, the final output signal of the binary counter 10 is applied to a counter 16, which executes a counting operation in synchronism with the final output signal of the binary counter 10. The content of the counter 16 is applied to a decoder 17, which generates digit signals $T_1'$–$T_n'$ in succession in accordance with the content of the counter 16. Each of the digit signals $T_1'$–$T_n'$ becomes one input signal of the corresponding one of AND circuits 18-1 to 18-n, while the other inputs of the AND circuits 18-1 to 18-n are supplied with the output Q of the flip-flop 15 in common.

Figure 7:
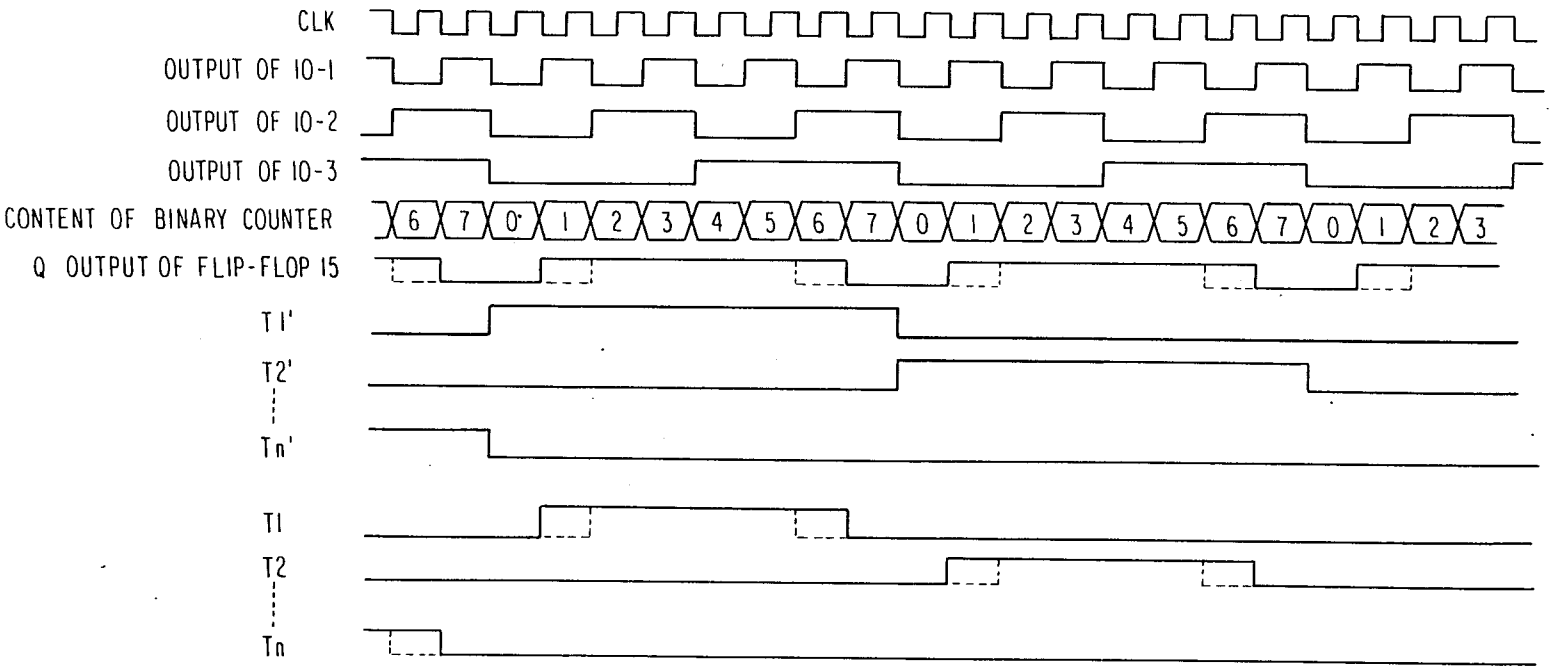
FIG. 7 is a timing chart for explaining operations in the embodiment of FIG. 6.

Now, the operation of the apparatus in FIG. 6 will be described. In order to clarify the description, the bit arrangements of the binary counter 10 and the register 14 are assumed to consist of the three bits 10-1, 10-2 and 10-3, and 14-1, 14-2 and 14-3, respectively. FIG. 7 shows a timing chart of the operations. The binary counter 10 is supplied with the clock signal CLK as shown in FIG. 7, and the outputs of the respective stages 10-1, 10-2 and 10-3 of the binary counter 10 become waveforms shown at 10-1, 10-2 and 10-3 in FIG. 7. Accordingly, the content of the binary counter 10 sequentially repeats counts "0"–"7". On the other hand, the register 14 is assumed to store a set value "1" therein. Then, the comparator 12 sets the flip-flop 15 when the content of the binary counter 10 has become "1". As a result, the output Q of the flip-flop 15 assumes the high level. Further, the comparator 13 resets the flip-flop 15 when the content of the binary counter 10 has coincided with the two's complement value of the set value in the register 14, namely, "7". Thus, the output Q of the flip-flop 15 assumes the low level in response to the output of the comparator 13. The output Q of the flip-flop 15 accordingly becomes a signal which changes to the high level when the content of the binary counter 10 has become "1" and to the low level when it has become "7", as illustrated in FIG. 7. The counter 16 generates the digit signals $T_1'$–$T_n'$ shown in FIG. 7 in synchronism with the output signals of the binary counter 10-3. These signals are respectively subjected to the operations of logical products with the output Q of the flip-flop 15 by the AND circuits 18-1 to 18-n. As shown in FIG. 7, the outputs $T_1$–$T_n$ of the AND circuits 18-1–18-n have the start timings of active period delayed and the end timings of the active periods advanced with respect to the corresponding outputs $T_1'$–$T_n'$ of the decoder 17, thereby producing digit signal waveforms which include no overlap. Consequently, even when the deviations attributed to the slowly transitioning waveforms of the digit and display information signals as shown in FIG. 2 have arisen, correct display can be always obtained without the erroneous display.

In a case where the set value of the register 14 is "2", the output Q of the flip-flop 15 becomes the high level when the content of the binary counter 10 is "2". It becomes the low level when the content of the binary counter 10 is the two's complement of the set values of the register 14, namely, "6". Accordingly, the digit signals $T_1$–$T_n$ have the active (high level) periods made narrower as indicated by broken lines in FIG. 7. That is, even when a large-sized display unit is driven in which the digit and display information signals might have very slow transitions, correct display free from the erroneous display can be obtained. The content of the register 14 may be manually set by external terminals or the like, or may be automatically set by an instruction from a CPU (central processing unit) or the like. While, in the above description, the binary counter and the register have been exemplified as having the 3-bit arrangements, they may be constructed with any desired number of bits.

As described above, according to this embodiment, even when various display units are driven by setting a predetermined value in the register, excellent display apparatuses which are free from erroneous display and which afford an appropriate luminance of display can be provided. Moreover, since the luminance of the display unit can be freely varied by changing the set value of the register, the erroneous recognition of the display can be prevented in such a way that the display unit is made easy to see by lowering the luminance in a dark background and raising it in a bright background.

FIG. 8 shows still another embodiment of the present invention. Here, the control of digit signals is performed by means of a microprocessor. A display device 20 having n display blocks $D_1$–$D_n$ is coupled with a display information generator circuit 23, and the respective digits thereof are supplied with display segment information in common. The segment information are fed to the digits selected in time division by digit signals $T_1$–$T_n$ which are the outputs of AND gates $A_1$–$A_n$. The digit signals are successively produced by decoding the content of a counter 22 by means of a decoder 21. Herein, the transmission of these digit signals to the display device is controlled by the output Q of a flip-flop 24 entering one input of each of all the AND gates. The flip-flop 24 has its output controlled by a first comparator 25 coupled to the set terminal thereof and a second comparator 26 coupled to the reset terminal thereof. The first comparator 25 and the second comparator 26 have comparison values set therein separately by a microprocessor 27. The timing of this setting is controlled by the output 29 of a frequency divider 28, and the comparison values are set in registers within the comparators each time the frequency division output 29 is generated. The frequency divider 28 performs a frequency dividing operation on the basis of a clock signal 30 supplied from the microprocessor 27, and generates the output at a predetermined frequency division ratio (equal to a frame period per display digit) and also acts as a counter of the clock signal 30. Accordingly, the respective comparison values independent of each other are set in the comparators 25 and 26 at the starting point of the allotted frame period to each display digits. The set comparison values are compared with the value of the clock counter in the frequency divider 28. When they have coincided, the comparators 25 and 26 provide outputs. The first comparator 25 determines the rises (starting points) of the digit signals $T_1$–$T_n$ to be transmitted to the display blocks, while the second comparator 26 determines the falls (end points) thereof. Unlike the preceding embodiment of FIG. 6, this embodiment can determine the transmission start timing and end timing of each digit signal independently of each other and is especially effective for display elements each having rise and fall characteristics which are not similar.

Similar means may be used for controlling the display information signals, not the digit signals. Both the digit signals and the display information signals may be controlled as well.

I claim:

1. A display apparatus comprising:

a display device having a plurality of display elements;

display information generating means for generating a display information to be displayed;

first applying means for applying the display information in common to said plurality of display elements;

first signal generating means for generating a train of first signals to be sequentially applied to said plurality of display elements, one by one, each of said first signals having a first pulse width defined by a start time and an end time;

control signal generating means for generating a control signal having a second pulse width defined by a start time and an end time which is shorter in duration than said first pulse width, the start time of said control signal being later than the start time of said first signal and the end time of said control signal being sooner than the end time of said first signal; and second applying means operatively connected to said control signal generator means and said first signal generating means for applying said first signals to the corresponding ones of said plurality of display elements only when said control signal is generated, whereby following the end time of a first signal pulse, a subsequent first signal pulse will result in a display only for the period that said control signal pulse is present.

2. A display apparatus as claimed in claim 1, wherein said first signal generating means has a plurality of output terminals corresponding to said plurality of display elements, one of said plurality of output terminals being operatively connected to one of the plurality of display elements via said second applying means, and said control signal being applied to said second applying means.

3. A display apparatus as claimed in claim 1, further comprising means for selectively changing said second pulse width of said control signal.

4. A display apparatus as claimed in claim 1, in which said first signal generating means includes means for determining said start timing and said end timing of said first signal, and said control signal generating means includes means supplying a first reference and a second reference signal; a first comparator comparing a content of said determining means with said first reference signal to determine said start timing of said control signal, and a second comparator comparing the content of said determining means with said second reference signal to determine said end timing of said control signal.

5. A display apparatus comprising:

a display device having a plurality of displayable digits;

display information producing means for producing a display information to be displayed;

means for applying the display information to said plurality of digits in common;

a first counter means counting to a first predetermined value in response to clock pulses and generating a timing signal whenever the predetermined value is counted;

a second counter means responsive to said timing signal for counting to a second value;

a decoder coupled to said second counter means and responsive to the content thereof to generate sequential digit signals at a predetermined time interval, each of said digit signals having a predetermined pulse width;

gate circuit means connected at a first input to receive gate turn on and turn off signals and at a second input to receive said digit signals and at an output to produce an output to a single digit;

means producing a first reference signal and a second reference signal;

a first comparator comparing said first reference signal with a content of said first counter and generating a first control signal when the first reference signal coincides with the content of said first counter;

a second comparator comparing said second reference signal with a content of said first counter and generating a second control signal when the second reference signal coincides with the content of said first counter; and a gate control circuit generating a gate turn-on signal in response to said first control signal and a gate turn-off signal in response to said second control signal, respectively, and applying said gate turn-on signal and said gate turn-off signal to said gate circuit, said gate circuit being turned on to transfer said digit signal to said single digit of said display device when said gate turn-on signal is applied thereto and being turned off to prevent application of said digit signal to said single digit when said gate turn-off signal is applied thereto.

6. A display apparatus as claimed in claim 5, further comprising a register for storing said first reference signal, said second reference signal being produced by complementing said first reference signal.

7. A display apparatus as claimed in claim 5, in which said gate control circuit has a flip-flop circuit receiving said first control signal at a set input terminal for generating said gate turn-on signal and receiving said second control signal at a reset input terminal for generating said gate turn-off signal.

8. A display apparatus comprising:

a clock signal source;

a display device having a plurality of display elements;

a display information signal generator coupled to said display elements in common for generating a display information signal;

a plurality of AND gate circuits, each having a first input end, a second input end and an output end, each said output end being coupled to a respective one of said display elements and producing an output signal for determining the start time and the end time for the actuation of said display element;

a means for receiving clock signals from said clock signal source and for processing and counting the number of said received clock signals;

a first comparator and a second comparator for comparing the number of clock signals counted by said receiving means with a first predetermined value and a second predetermined value, respectively, and generating a first signal and a second signal when said number coincides with said first and second predetermined values, respectively;

a flip-flop circuit, for supplying an output to said first ends of all said AND gate circuits, which has a reset and a set terminal supplied with said first and second signals from said first and second comparators, respectively;

a counter for counting the processed clock signals from said receiving means;

a decoder for decoding the content of said counter and supplying digit signals to said second input ends of said AND gate circuits successively on the basis of the decoded result, said digit signals having a first period, whereby the duration of consecutive display element energization may be controlled to be shorter than said first period.

* * * * *